US011754955B2

(12) United States Patent
Hinoue et al.

(10) Patent No.: US 11,754,955 B2
(45) Date of Patent: Sep. 12, 2023

(54) IMAGE FORMING APPARATUS

(71) Applicant: BROTHER KOGYO KABUSHIKI KAISHA, Nagoya (JP)

(72) Inventors: Kazuma Hinoue, Nagoya (JP); Shintaro Suzuki, Nagoya (JP); Sota Hirano, Kasugai (JP); Ayaka Komori, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/815,611

(22) Filed: Jul. 28, 2022

(65) Prior Publication Data

US 2022/0365470 A1 Nov. 17, 2022

Related U.S. Application Data

(63) Continuation of application No. PCT/JP2020/044626, filed on Dec. 1, 2020.

(30) Foreign Application Priority Data

Jan. 29, 2020 (JP) ..... 2020-012144

(51) Int. Cl.
*G03G 15/08* (2006.01)
*G03G 15/00* (2006.01)

(52) U.S. Cl.
CPC ..... *G03G 15/5016* (2013.01); *G03G 15/0863* (2013.01); *G03G 15/553* (2013.01)

(58) Field of Classification Search
CPC ..... G03G 15/0856; G03G 15/0863; G03G 15/5016; G03G 15/55; G03G 15/553; G03G 15/556
See application file for complete search history.

(56) References Cited

U.S. PATENT DOCUMENTS 6,175,375 B1 1/2001 Able et al.
2008/0075481 A1 3/2008 Sugaya
(Continued)

FOREIGN PATENT DOCUMENTS

JP 2008-107813 A 5/2008
JP 2009-265401 A 11/2009
(Continued)

OTHER PUBLICATIONS

International Search Report of the International Searching Authority issued in corresponding International Patent Application No. PCT/JP2020/044626, dated Feb. 16, 2021.
(Continued)

*Primary Examiner* — Hoang X Ngo
(74) *Attorney, Agent, or Firm* — Merchant & Gould P.C.

(57) ABSTRACT

An image forming apparatus includes a main body including a display, a drum cartridge configured to be mounted to the main bod, a toner cartridge configured to be mounted to the drum cartridge, and a controller. The drum cartridge includes a photosensitive drum, a developing chamber configured to accommodate toner, and a drum memory. The toner cartridge includes a housing configured to accommodate the toner. The controller is configured to store, in the drum memory, a cumulative toner receiving amount which is a cumulative amount of the toner supplied from the toner cartridge and received in the developing chamber, a cumulative toner consumption amount which is a cumulative amount of the consumed toner, and a cumulative drum printing sheet number which is a number of sheets on which an image is formed.

20 Claims, 10 Drawing Sheets

(56) References Cited

U.S. PATENT DOCUMENTS

| | | | | |
|---|---|---|---|---|
| 2009/0269086 | A1 | 10/2009 | Mikuni | |
| 2018/0267428 | A1* | 9/2018 | Kawajiri | G03G 15/553 |
| 2019/0155189 | A1 | 5/2019 | Hinoue et al. | |
| 2019/0196394 | A1* | 6/2019 | Yabuki | G03G 15/0863 |
| 2019/0302640 | A1* | 10/2019 | Sano | G03G 15/065 |

FOREIGN PATENT DOCUMENTS

| | | | |
|---|---|---|---|
| JP | 2018-151564 | A | 9/2018 |
| JP | 2019-95608 | A | 6/2019 |
| JP | 2019-117346 | A | 7/2019 |
| JP | 2019-164336 | A | 9/2019 |
| JP | 2021-81641 | A | 5/2021 |

OTHER PUBLICATIONS

International Preliminary Report on Patentability issued in corresponding International Patent Application No. PCT/JP2020/044626, dated Jul. 28, 2022.

* cited by examiner

IMAGE FORMING APPARATUS

REFERENCE TO RELATED APPLICATIONS

This is a continuation application of International Application No. PCT/JP2020/044626 filed on Dec. 1, 2020 which claims priority from Japanese Patent Application No. 2020-012144 filed on Jan. 29, 2020. The entire contents of the earlier applications are incorporated herein by reference.

BACKGROUND ART

In the related art, an image forming apparatus to which a drum cartridge and a toner cartridge are mounted is known. In the image forming apparatus, the drum cartridge in a state where the toner cartridge is assembled to the drum cartridge is mounted to the image forming apparatus.

DESCRIPTION

In the image forming apparatus to which the drum cartridge and the toner cartridge are mountable, the drum cartridge is replaced when the drum cartridge has reached the end of a lifetime, and the toner cartridge is replaced when the toner cartridge has reached the end of a lifetime. When only the drum cartridge is replaced, the toner cartridge assembled in the drum cartridge is assembled in a new drum cartridge, and then is mounted to the image forming apparatus. In this case, the toner cartridge may reach the end of its lifetime immediately after the drum cartridge is replaced.

Therefore, an object of the present disclosure is to provide an image forming apparatus which reduces a number of times a drum cartridge and a toner cartridge are individually replaced.

According to an aspect of the present disclosure, an image forming apparatus includes a main body including a display, a drum cartridge configured to be mounted to the main body and includes a photosensitive drum, a developing chamber configured to accommodate toner, and a drum memory, a toner cartridge configured to be mounted to the drum cartridge and including a housing configured to accommodate the toner, a supply unit configured to supply the toner from the housing to the developing chamber and a toner memory, and a controller.

The controller is configured to store, in the drum memory, a cumulative toner receiving amount which is a cumulative amount of the toner supplied from the toner cartridge and received in the developing chamber, a cumulative toner consumption amount which is a cumulative amount of the consumed toner, and a cumulative drum printing sheet number which is a number of sheets on which an image is formed by the photosensitive drum, and store, in the toner memory, a cumulative toner supply amount which is a cumulative amount of the toner supplied by the supply unit from the housing to the developing chamber.

The controller is configured to display, on the display. a message requesting replacement of the drum cartridge in a case where the controller determines that the cumulative drum printing sheet number is equal to or higher than a first given sheet number for determining whether the drum cartridge is empty.

The controller is configured to display, on the display, a message requesting replacement of the toner cartridge in a case where the controller determines that the cumulative toner supply amount of the toner cartridge is equal to or higher than a first supply amount for determining whether the toner cartridge is empty.

The controller is configured to, in a case where the controller determines that the cumulative toner supply amount is equal to or higher than the first supply amount and the cumulative drum printing sheet number is equal to or higher than a second given sheet number which is lower than the first given sheet number, cause the display not to display any message requesting replacement of the drum cartridge or the toner cartridge d regardless of whether the cumulative drum printing sheet number is equal to or higher than the first given sheet number, and display, on the display, a message requesting replacement of both the drum cartridge and the toner cartridge on a condition that the value obtained by subtracting the cumulative toner consumption amount from the cumulative toner receiving amount is equal to or lower than the first threshold.

According to the image forming apparatus having this configuration, in a case where the cumulative toner supply amount is equal to or higher than the first supply amount and the cumulative drum printing sheet number is equal to or higher than the second given sheet number which is lower than the first given sheet number, the display does not display the message that any of the drum cartridge and the toner cartridge is requested to be replaced until the value obtained by subtracting the cumulative toner consumption amount from the cumulative toner receiving amount becomes equal to or lower than the first threshold regardless of whether the cumulative drum printing sheet number is equal to or higher than the first given sheet number, and thus a number of times the drum cartridge and the toner cartridge are individually replaced is reduced.

The controller may be configured to display, on the display, a message indicating that the drum cartridge is close to empty in a case where the controller determines that the cumulative drum printing sheet number is equal to or higher than the second given sheet number.

Accordingly, in a case where the cumulative drum printing sheet number is equal to or higher than the second given sheet number, the display displays a message indicating that the drum cartridge is close to empty, so that a user notices that the drum cartridge is about to reach the end of a lifetime.

According to another aspect of the present disclosure, an image forming apparatus includes a main body including a display, a drum cartridge configured to be mounted to the main body and including a photosensitive drum, a developing chamber configured to accommodate toner, and a drum memory, a toner cartridge configured to be mounted to the drum cartridge and including a housing configured to accommodate the toner, a supply unit configured to supply the toner from the housing to the developing chamber, and a toner memory, and a controller.

The controller is configured to store, in the drum memory, a cumulative toner receiving amount which is a cumulative amount of the toner supplied from the toner cartridge and received in the developing chamber, a cumulative toner consumption amount which is a cumulative amount of the consumed toner, and a cumulative rotation number of the photosensitive drum performing image formation, and store, in the toner memory, a cumulative toner supply amount which is a cumulative amount of the toner supplied by the supply unit from the housing to the developing chamber.

The controller is configured to display, on the display, a message requesting replacement of the drum cartridge in a case where the controller determines that the cumulative rotation number is equal to or higher than a first given number for determining whether the drum cartridge is empty.

The controller is configured to display, on the display, a message requesting replacement of the toner cartridge in a case where the controller determines that the cumulative toner supply amount of the toner cartridge is equal to or higher than a first supply amount for determining whether the toner cartridge is empty.

The controller is configured to, in a case where the controller determines that the cumulative toner supply amount is equal to or higher than the first supply amount and the cumulative rotation number is equal to or higher than a second given number which is lower than the first given number, cause the display not to display any message requesting replacement of the drum cartridge or the toner cartridge until a value obtained by subtracting the cumulative toner consumption amount from the cumulative toner receiving amount becomes equal to or lower than a first threshold regardless of whether the cumulative rotation number is equal to or higher than the first given number, and display, on the display, a message requesting replacement of both the drum cartridge and the toner cartridge on a condition that the value obtained by subtracting the cumulative toner consumption amount from the cumulative toner receiving amount is equal to or lower than the first threshold.

According to the image forming apparatus having this configuration, in a case where the cumulative toner supply amount is equal to or higher than the first supply amount and the cumulative rotation number is equal to or higher than the second given number, the display does not display the message that any of the drum cartridge and the toner cartridge is requested to be replaced until the value obtained by subtracting the cumulative toner consumption amount from the cumulative toner receiving amount becomes equal to or lower than the first threshold regardless of whether the cumulative rotation number is equal to or higher than the first given number, and thus a number of times the drum cartridge and the toner cartridge are individually replaced may be reduced.

The controller may be configured to display, on the display, a message indicating that the drum cartridge is close to empty in a case where the controller determines that the cumulative drum printing sheet number is equal to or higher than the second given sheet number.

Accordingly, in a case where the cumulative rotation number is equal to or higher than the second given number, the display displays a message indicating that the drum cartridge is close to empty, so that a user notices that the drum cartridge is about to reach the end of a lifetime.

The controller may be configured to cause the supply unit to supply the toner with a first given amount to the developing chamber in a case where the value obtained by subtracting the cumulative toner consumption amount from the cumulative toner receiving amount stored in the drum memory is equal to or lower than a second threshold.

The supply unit includes an auger that may be configured to supply the toner to the developing chamber by rotating about a rotation shaft, and the controller may be configured to acquire the cumulative toner supply amount based on a rotation number of a motor that drives the auger.

The controller may be configured to obtain the cumulative toner consumption amount based on a dot count number of an image formed by the image forming apparatus.

The controller may be configured to perform a new product determination process of determining whether the drum cartridge mounted to the main body is new, and a supply process of causing the supply unit to supply the toner with a second given amount to the developing chamber in a case where the controller determines that the drum cartridge mounted to the main body is new.

The controller may be configured to perform a first mounting determination process of determining whether the drum cartridge is mounted to the main body, an emptiness determination process of determining whether the cumulative toner supply amount of the toner cartridge is equal to or higher than a second threshold for determining whether the toner cartridge is empty, and a process in which, in a case where the controller determines in the first mounting determination process that the drum cartridge is mounted to the main body, and the controller determines in the emptiness determination process that the cumulative toner supply amount of the toner cartridge is equal to or higher than the second threshold for determining whether the toner cartridge is empty, image formation is allowed until the value obtained by subtracting the cumulative toner consumption amount from the cumulative toner receiving amount becomes equal to or lower than a third threshold.

The controller may be configured to perform a first mounting determination process of determining whether the drum cartridge is mounted to the main body, a second mounting determination process of determining whether the toner cartridge is mounted to the drum cartridge, and a process in which, in a case where the controller determines in the first mounting determination process that the drum cartridge is mounted to the main body, and the controller does not determine in the second mounting determination process that the toner cartridge is mounted to the drum cartridge, image formation is allowed until the value obtained by subtracting the cumulative toner consumption amount from the cumulative toner receiving amount becomes equal to or lower than a third threshold.

The controller may be configured to perform a toner exhausting process to exhaust the toner remaining in the toner cartridge in a case where the cumulative toner supply amount is equal to or higher than a fourth threshold, add, to the cumulative toner receiving amount, an amount of the toner received from the toner cartridge into the developing chamber by the toner exhausting process and store the added value in the drum memory, and add, to the cumulative toner supply amount, an amount of the toner supplied from the toner cartridge by the toner exhausting control and store the added value to the toner memory.

The controller may be configured to obtain toner supply amounts from the toner cartridge mounted to the drum cartridge and obtain the cumulative toner receiving amount using the obtained toner supply amounts.

According to an image forming apparatus of the present disclosure, a number of times a drum cartridge and a toner cartridge are individually replaced is reduced.

Next, embodiments of the present disclosure will be described in detail with reference to the drawings as appropriate.

Figure 1:
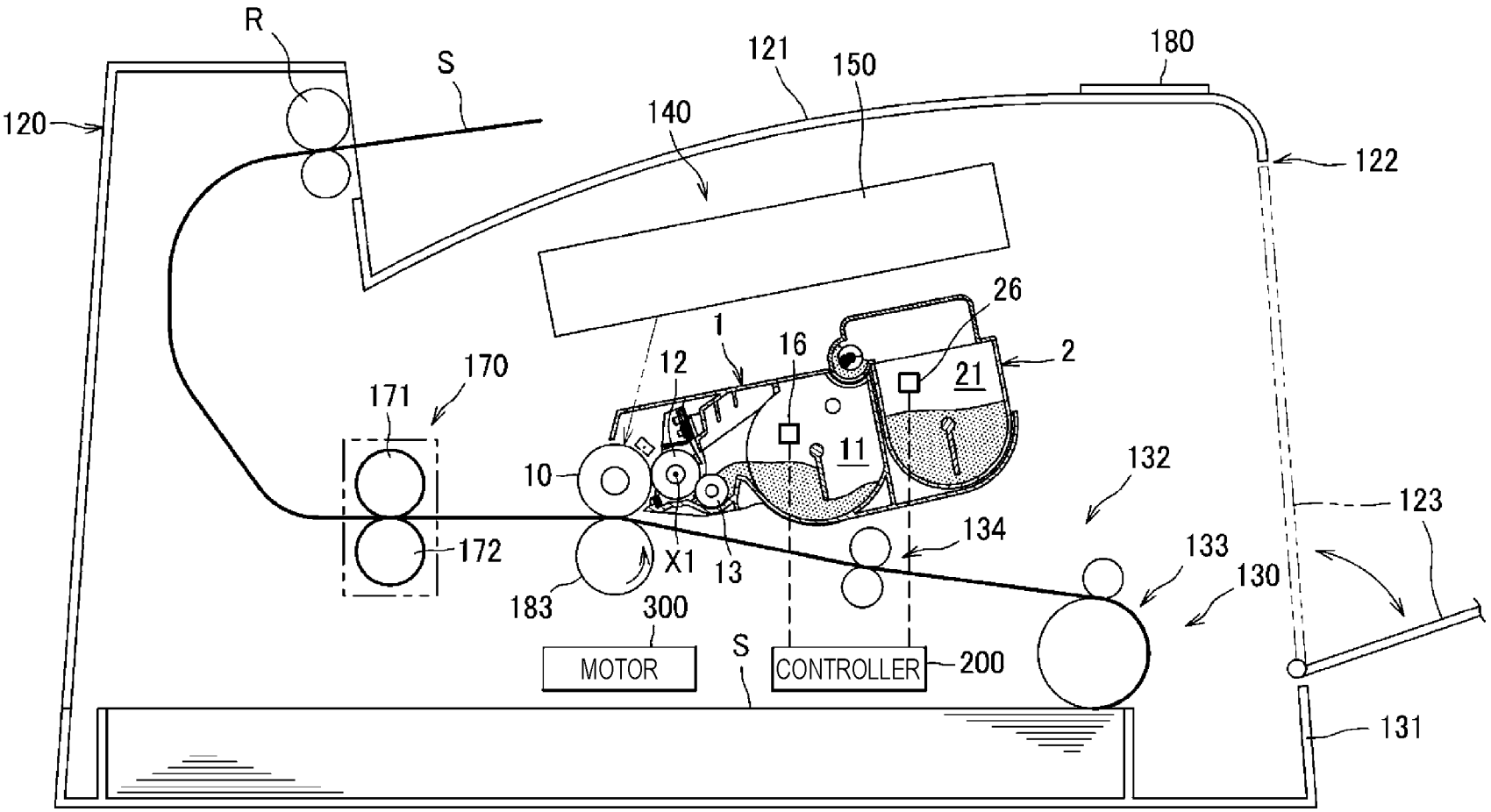
FIG. 1 is a cross-sectional view of an image forming apparatus according to an embodiment.

As shown in FIG. 1, an image forming apparatus 100 is a laser printer. The image forming apparatus 100 includes a main body 120, a feeder unit 130, an image forming unit 140, a display 180, a controller 200, and a motor 300. The feeder unit 130 feeds a sheet S. The image forming unit 140 forms an image on the sheet S. A driving force of the motor 300 is transmitted to the feeder unit 130 and the image forming unit 140.

The feeder unit 130 includes a sheet feed tray 131 and a convey mechanism 132. The sheet feed tray 131 is detachably mounted to the main body 120. The convey mechanism 132 conveys the sheet S in the sheet feed tray 131 toward a transfer roller 183 described later. The convey mechanism 132 includes a sheet feed mechanism 133 and a registration roller 134. The sheet feed mechanism 133 conveys the sheet S in the sheet feed tray 131 toward the registration roller 134. The registration roller 134 aligns positions of leading ends of the sheets S to be conveyed.

The image forming unit 140 includes a drum cartridge 1, a scanner unit 150, a fixing device 170, and the transfer roller 183.

The scanner unit 150 is provided at an upper portion in the main body 120, and includes a laser emitting unit, a polygon mirror, a lens, a reflection mirror which are not shown, and the like. In the scanner unit 150, a laser beam is emitted onto a surface of the photosensitive drum 10 described later, by high-speed scanning.

The main body 120 includes an opening 122 and a front cover 123. The front cover 123 is rotatably provided on a front wall. The opening 122 is opened and closed by the front cover 123. The drum cartridge 1 may be attached to and detached from the main body 120 through the opening 122. A detailed configuration of the drum cartridge 1 will be described below.

In the image forming unit 140, a surface of the rotating photosensitive drum 10 is uniformly charged by a charger 10B (see FIG. 2) described later, and then exposed by the high-speed scanning of the laser beam from the scanner unit 150. Accordingly, an electrostatic latent image based on image data is formed on the surface of the photosensitive drum 10.

Next, the toner in the drum cartridge 1 is supplied to the electrostatic latent image of the photosensitive drum 10, and a toner image is formed on the surface of the photosensitive drum 10. Thereafter, the sheet S is conveyed between the photosensitive drum 10 and the transfer roller 183, so that the toner image carried on the surface of the photosensitive drum 10 is transferred onto the sheet S.

The fixing device 170 includes a heating roller 171 and a pressing roller 172 pressing the heating roller 171. In the fixing device 170, when the sheet S passes between the heating roller 171 and the pressing roller 172, the toner transferred on the sheet S is thermally fixed.

The sheet S thermally fixed by the fixing device 170 is conveyed to a discharge roller R disposed at a downstream side of the fixing device 170, and is fed out from the discharge roller R onto a discharge tray 121.

The display 180 is located at an outer surface of the main body 120. In other words, the main body 120 includes the display 180. The display 180 displays various messages based on a command of the controller 200.

Figure 2:
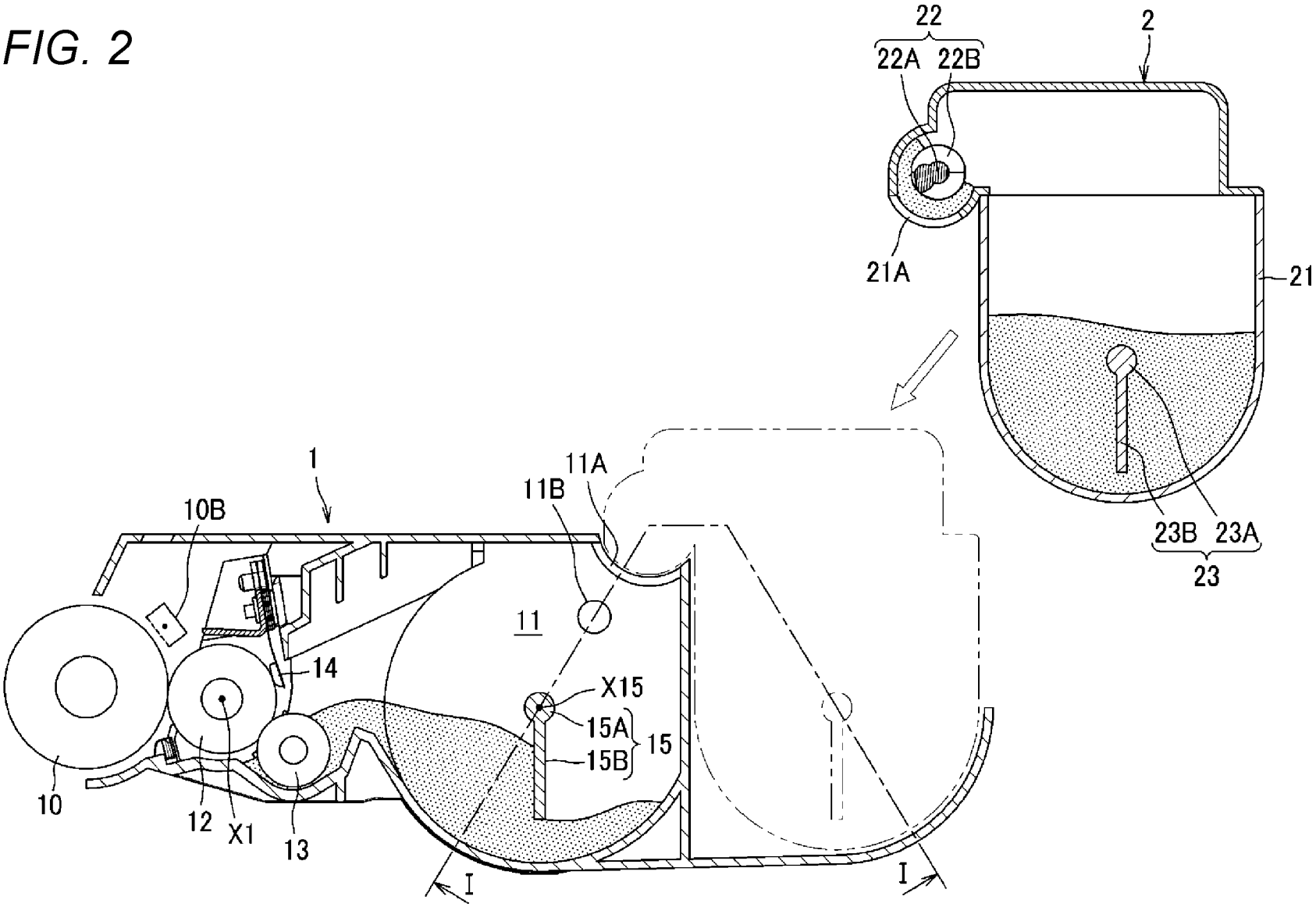
FIG. 2 is a cross-sectional view of a toner cartridge and a drum cartridge.

As shown in FIG. 2, the drum cartridge 1 includes the photosensitive drum 10, the charger 10B, the developing chamber 11, a developing roller 12, a supply roller 13, a layer thickness regulating blade 14, a first agitator 15, and a drum memory 16 (see also FIG. 1). The developing chamber 11 is configured to accommodate the toner inside.

The developing roller 12 is a roller that supplies the toner to the electrostatic latent image formed on the photosensitive drum 10. The developing roller 12 rotates about a rotation axis X1. In the following description, an extending direction of the rotation axis X1 of the developing roller 12 is simply referred to as the "axial direction".

The supply roller 13 is a roller that supplies the toner in the developing chamber 11 to the developing roller 12. The layer thickness regulating blade 14 is a member that regulates a thickness of the toner on the developing roller 12.

The first agitator 15 includes a shaft portion 15A that rotates about a first shaft X15 that extends in the axial direction, and a stirring blade 15B that is fixed to the shaft portion 15A. The developing chamber 11 rotatably supports the shaft portion 15A. The stirring blade 15B rotates together with the shaft portion 15A to stir the toner in the developing chamber 11.

The drum memory 16 is, for example, a memory such as an IC chip for storing information, and is not limited to the IC chip. In the present embodiment, the drum memory 16 stores a cumulative toner receiving amount and a cumulative toner consumption amount. The cumulative toner receiving amount is a cumulative amount of the toner supplied from the toner cartridge 2 and received in the developing chamber 11. The cumulative toner consumption amount is a cumulative amount of the toner consumed by image formation.

Figure 3:
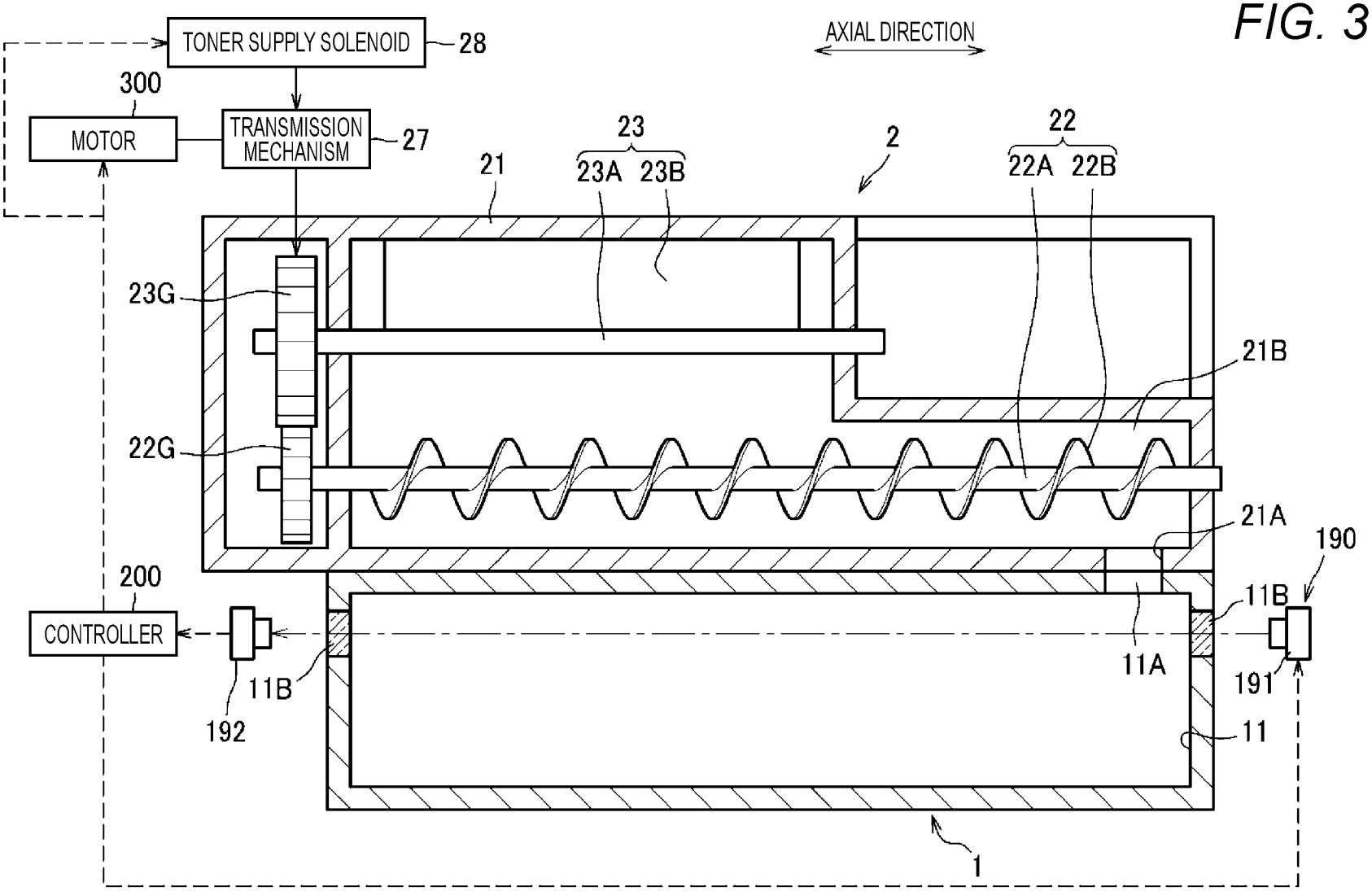
FIG. 3 is a cross-sectional view taken along I-I in FIG. 2.

As shown in FIG. 3, the image forming apparatus 100 includes a toner sensor 190 for detecting an amount of the toner in the developing chamber 11. The toner sensor 190 includes a light emitting element 191 that emits light into the developing chamber 11 and an optical sensor 192 that receives the light passing through the developing chamber 11 from the light emitting element 191. The light emitting element 191 and the optical sensor 192 are disposed in the main body 120. Specifically, the light emitting element 191 is disposed on one side in the axial direction with respect to the developing chamber 11, and the optical sensor 192 is disposed on the other side in the axial direction with respect to the developing chamber 11.

The developing chamber 11 includes windows 11B through which the light emitted from the light emitting element 191 may pass. The windows 11B are provided at wall surfaces on both sides of the developing chamber 11 in the axial direction. The window 11B is implemented by a member that transmits the light from the light emitting element 191. Walls on the both sides of the developing chamber 11 in the axial direction are implemented by members that do not transmit the light from the light emitting element 191. As shown in FIG. 2, the window 11B is located above the first shaft X15. Accordingly, the light emitted from the light emitting element 191 passes between the first shaft X15 and an auger 22 described later in an up-down direction.

The toner cartridge 2 is detachably attached to the drum cartridge 1 (see FIG. 2). The toner cartridge 2 is mounted to the main body 120 in a state of being mounted to the drum cartridge 1. The drum cartridge 1 may be mounted to the main body 120 even in a case where the toner cartridge 2 is not mounted. The toner cartridge 2 includes a housing 21, the auger 22, a second agitator 23, and a toner memory 26 (see also FIG. 1). The housing 21 accommodates the toner. The auger 22 is an example of a supply unit that supplies the toner from the housing 21 to the developing chamber 11. The second agitator 23 stirs the toner in the housing 21.

The auger 22 rotates about a rotation shaft 22A along the axial direction, and by rotating, the toner inside the housing 21 is moved along the axial direction. Specifically, the auger 22 is a screw auger having the rotation shaft 22A and a plate 22B spirally provided around the rotation shaft 22A. The plate 22B of the auger 22 is integrally formed with the rotation shaft 22A.

As shown in FIG. 3, the housing 21 includes a discharging port 21A and a toner transport unit 21B. The discharging port 21A transports the toner in the housing 21 to the drum cartridge 1. The toner transport unit 21B surrounds an outside of the auger 22. The toner transport unit 21B has a small diameter close to the outside of the auger 22. The developing chamber 11 of the drum cartridge 1 includes a receiving port 11A facing the discharging port 21A. The discharging port 21A and the receiving port 11A are located below the auger 22 and at one end side of the auger 22 in the axial direction. Accordingly, when the auger 22 rotates, the toner is transported toward one end side in the axial direction by the spiral plate 22B, and is supplied into the developing chamber 11 via the discharging port 21A and the receiving port 11A.

The auger 22 includes an auger gear 22G. The auger gear 22G is a gear that transmits a driving force to the auger 22, and is fixed to a shaft of the auger 22. Therefore, the auger 22 may rotate together with the auger gear 22G.

The second agitator 23 includes a shaft portion 23A extending in the axial direction and a stirring blade 23B provided at the shaft portion 23A. A second agitator gear 23G is fixed to an end portion of the shaft portion 23A of the second agitator 23. The second agitator gear 23G meshes with the auger gear 22G. Therefore, the second agitator 23 may rotate together with the second agitator gear 23G by the rotation of the auger gear 22G.

A driving force of the motor 300 is transmitted to the auger gear 22G via a transmission mechanism 27. The transmission mechanism 27 transmits the driving force of the motor 300 to the auger gear 22G when a toner supply solenoid 28 is turned on, and does not transmit the driving force of the motor 300 to the auger gear 22G when the toner supply solenoid 28 is turned off. The controller 200 controls ON and OFF of the toner supply solenoid 28. In this manner, when the controller 200 turns on the toner supply solenoid 28, the auger 22 rotates and the toner in the housing 21 is supplied to the developing chamber 11. When the controller 200 turns off the toner supply solenoid 28, the auger 22 does not rotate, and thus the toner in the housing 21 is not supplied to the developing chamber 11.

The toner memory 26 is, for example, a memory such as an IC chip for storing information, and is not limited to the IC chip. In the present embodiment, the toner memory 26 stores a cumulative toner supply amount. The cumulative toner supply amount is a cumulative amount of the toner supplied by the auger 22 from the housing 21 to the developing chamber 11.

Figure 4:
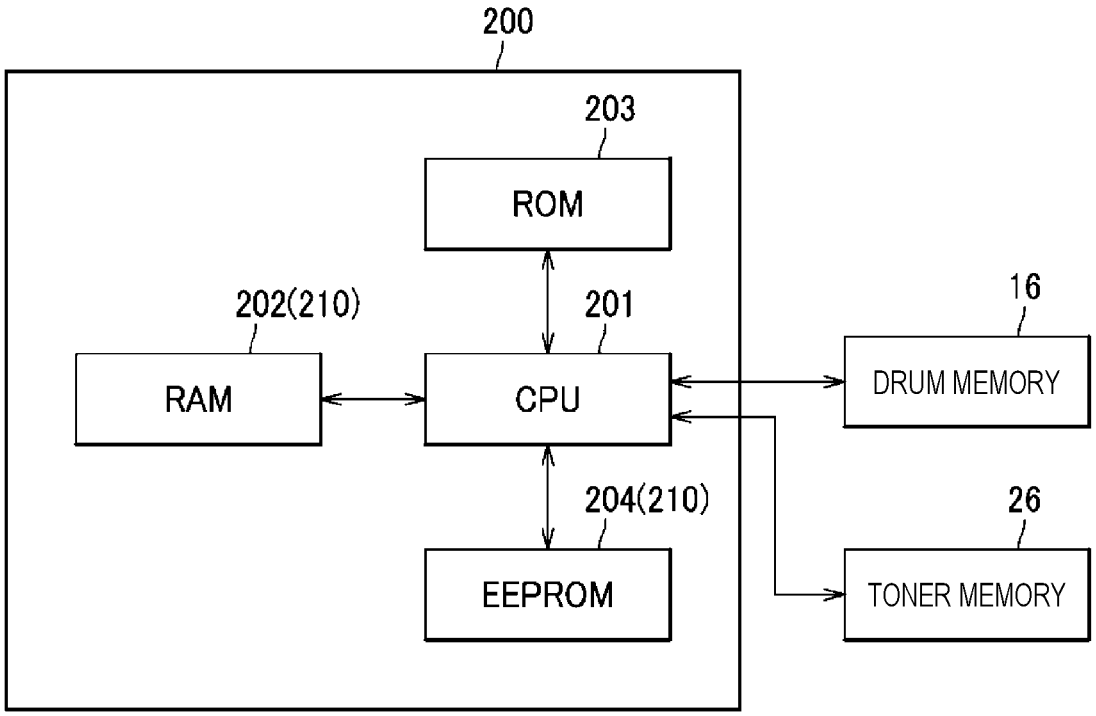
FIG. 4 is a diagram illustrating an electrical connection of a controller, a main body memory, a drum memory, and a toner memory.

As shown in FIG. 4, the controller 200 includes, for example, a CPU 201, a RAM 202, a ROM 203, an EEPROM 204, and an input and output circuit, and performs a print control by performing an arithmetic process based on information of the mounted cartridge, programs and data stored in the RAM 202 and the ROM 203, and the like. The RAM 202 and the EEPROM 204 are examples of a main body memory 210. The RAM 202 is an example of a volatile memory. The EEPROM 204 is an example of a non-volatile memory. In the present embodiment, the CPU 201 is electrically connected to the RAM 202, the ROM 203, the EEPROM 204, the drum memory 16, and the toner memory 26.

Next, a process performed by the controller 200 will be described in detail. First, the process performed by the controller 200 will be described, and then an example of the process of the embodiment performed by the controller 200 will be described with reference to flowcharts of FIGS. 5 to 11.

The controller 200 performs any of a normal printing process, a toner exhausting process, a first special printing process, and a second special printing process according to a cumulative drum printing sheet number of the drum cartridge 1 and a remaining amount of the toner in the toner cartridge 2.

The controller 200 causes the drum memory 16 to store the cumulative toner receiving amount, the cumulative toner consumption amount, and the cumulative drum printing sheet number, and causes the toner memory 26 to store the cumulative toner supply amount.

The cumulative toner receiving amount is the cumulative amount of the toner supplied from the toner cartridge 2 and received in the developing chamber 11. The cumulative toner consumption amount is the cumulative amount of the toner consumed by the image formation. The cumulative drum printing sheet number is a printing number of sheets formed with an image by the photosensitive drum 12. The cumulative toner supply amount is the cumulative amount of the toner supplied by the supply unit, that is, the auger 22 from the housing 21 to the developing chamber 11.

Figure 5:
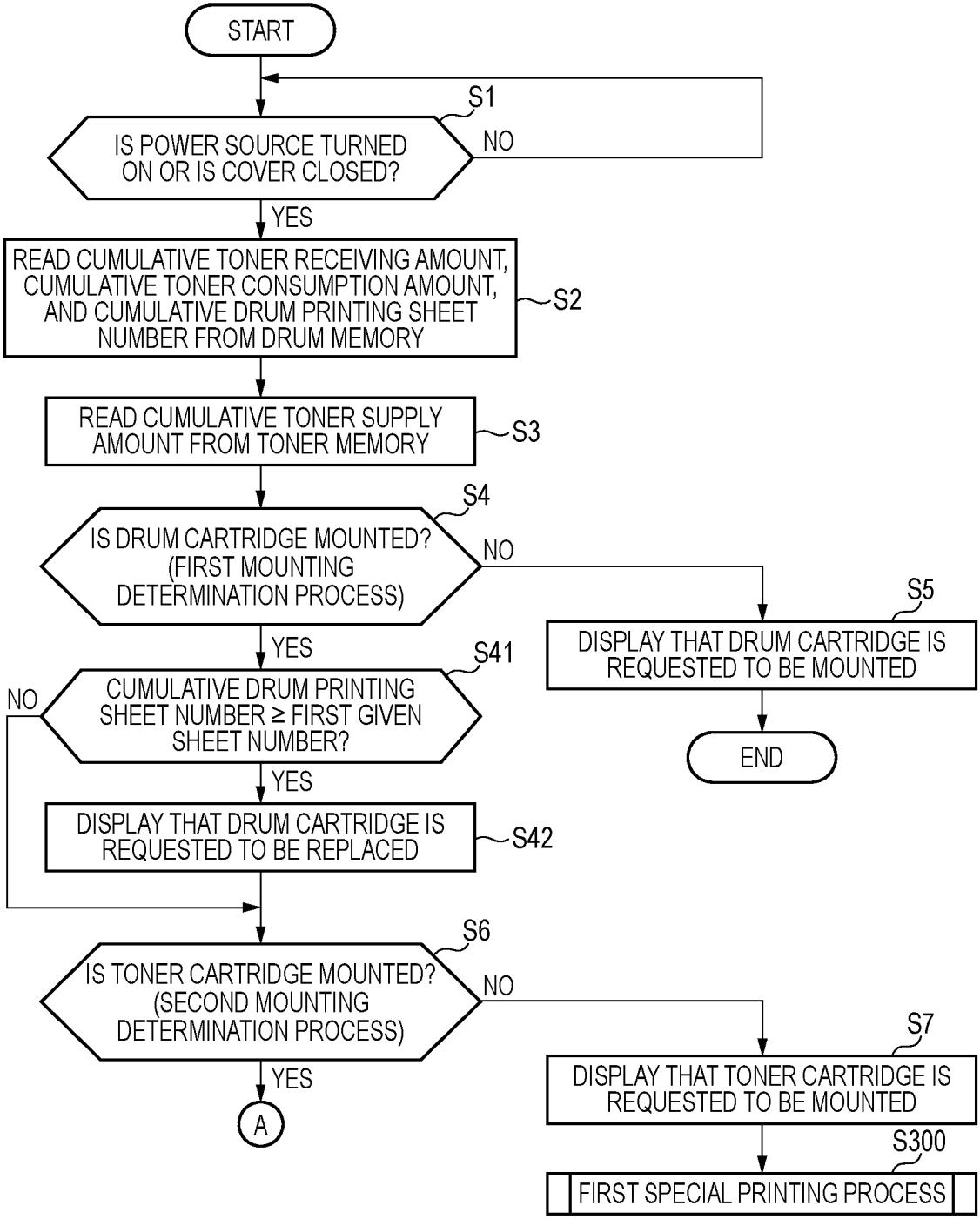
FIG. 5 is a flowchart showing an operation performed by the controller after a power source is turned on or a cover is closed.

In a case where the controller 200 determines that the power source is turned on or the front cover 123 is closed, assuming that at least any of the drum cartridge 1 and the toner cartridge 2 may be replaced, the controller 200 reads the cumulative toner receiving amount, the cumulative toner consumption amount, and the cumulative drum printing sheet number from the drum memory 16 and reads the cumulative toner supply amount from the toner memory 26 to perform a first mounting determination process (see S1 to S5 in FIG. 5).

The first mounting determination process is a process of determining whether the drum cartridge 1 is mounted to the main body 120. Specifically, the controller 200 attempts communication when reading information from the drum memory 16, and determines that the drum cartridge 1 is mounted to the main body 120 in a case where the communication is successful. The controller 200 displays on the display 180 a message requesting replacement of the drum cartridge 1 in a case where the controller 200 determines that the drum cartridge 1 is not mounted to the main body 120.

After the first mounting determination process, the controller 200 causes the display 180 to display a message requesting replacement of the drum cartridge in a case where the controller determines that the cumulative drum printing sheet number is equal to or higher than a first given sheet number. The first given sheet number is a given sheet number for which the cumulative drum printing sheet number determines that the drum cartridge 1 is empty, that is, a lifetime of the drum cartridge 1. Thereafter, the controller 200 performs a second mounting determination process.

The second mounting determination process is a process of determining whether the toner cartridge 2 is mounted to the drum cartridge 1. Specifically, the controller 200 attempts communication when reading information from the toner memory 26, and determines that the toner cartridge 2 is mounted to the drum cartridge 1 in a case where the communication is successful. In a case where the controller 200 determines in the first mounting determination process that the drum cartridge 1 is mounted to the main body 120, and does not determine in the second mounting determination process that the toner cartridge 2 is mounted to the drum cartridge 1, the controller 200 displays on the display 180 a message requesting replacement of the toner cartridge 2, and performs the first special printing process (see S300 in FIG. 10).

After determining that the drum cartridge 1 and the toner cartridge 2 are mounted, the controller 200 performs a new product determination process (see S8 in FIG. 6) of determining whether the drum cartridge 1 mounted to the main body 120 is new. In a case where the cumulative toner receiving amount read from the drum memory 16 is zero, the controller 200 may determine that the drum cartridge 1 mounted to the main body 120 is new.

In the new product determination process, in a case where the controller determines that the drum cartridge 1 mounted to the main body 120 is new, the controller 200 turns on the toner supply solenoid 28 for a given time, and performs a supply process (see S9 in FIG. 6) in which the auger 22 supplies a second given amount of the toner to the developing chamber 11. Then, the controller 200 causes the drum memory 16 to store the second given amount as the cumulative toner receiving amount, and causes the toner memory 26 to store, as the cumulative toner supply amount, an amount obtained by adding the second given amount to the cumulative toner supply amount read from the toner memory 26 in step S3 (S10).

In a case where the controller does not determine in the new product determination process that the drum cartridge 1 mounted to the main body 120 is new, the controller 200 determines whether the cumulative toner supply amount read from the toner memory 26 is equal to or higher than a second supply amount.

Figure 6:
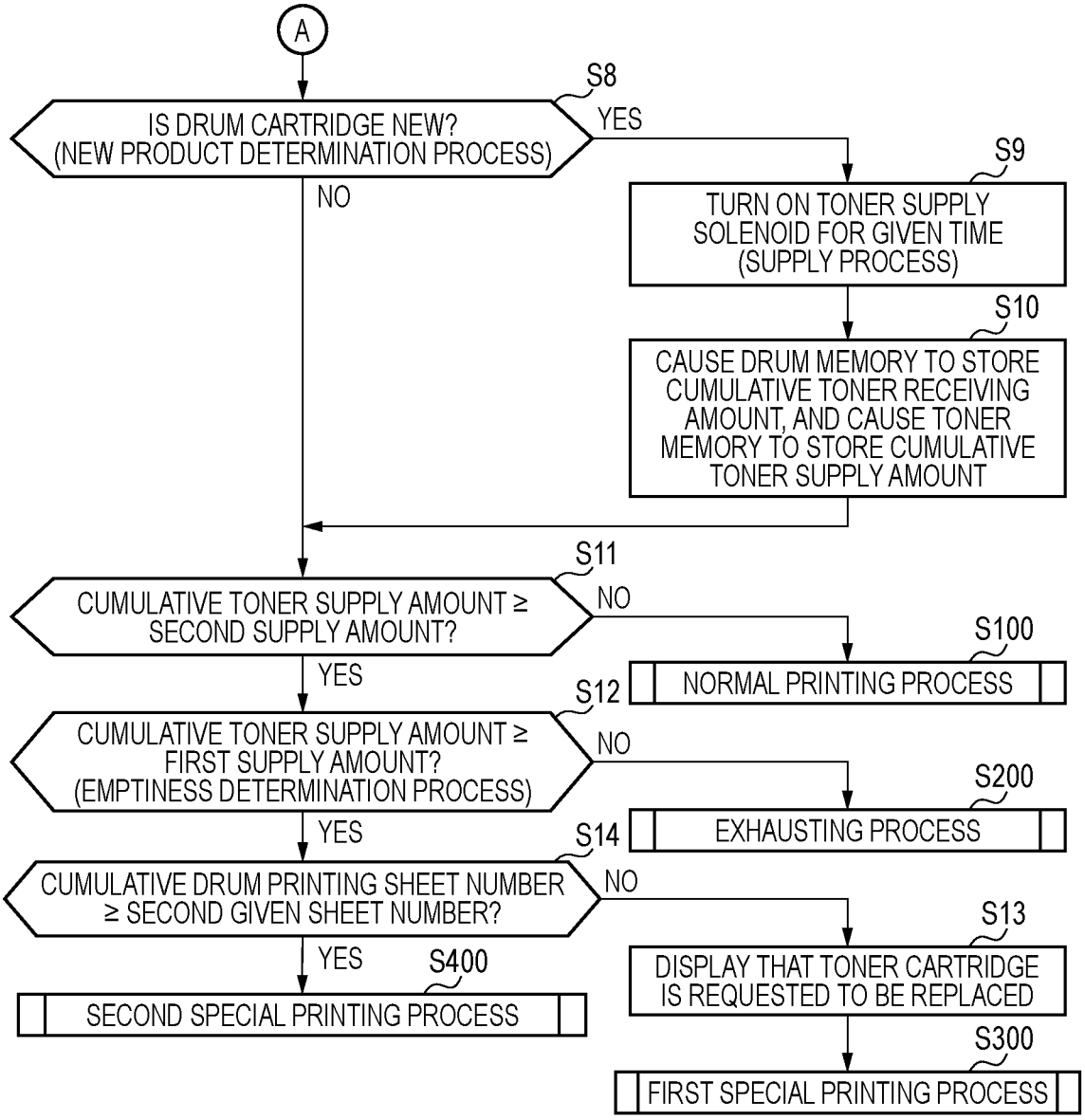
FIG. 6 is a flowchart continued from FIG. 5.
Figure 7:
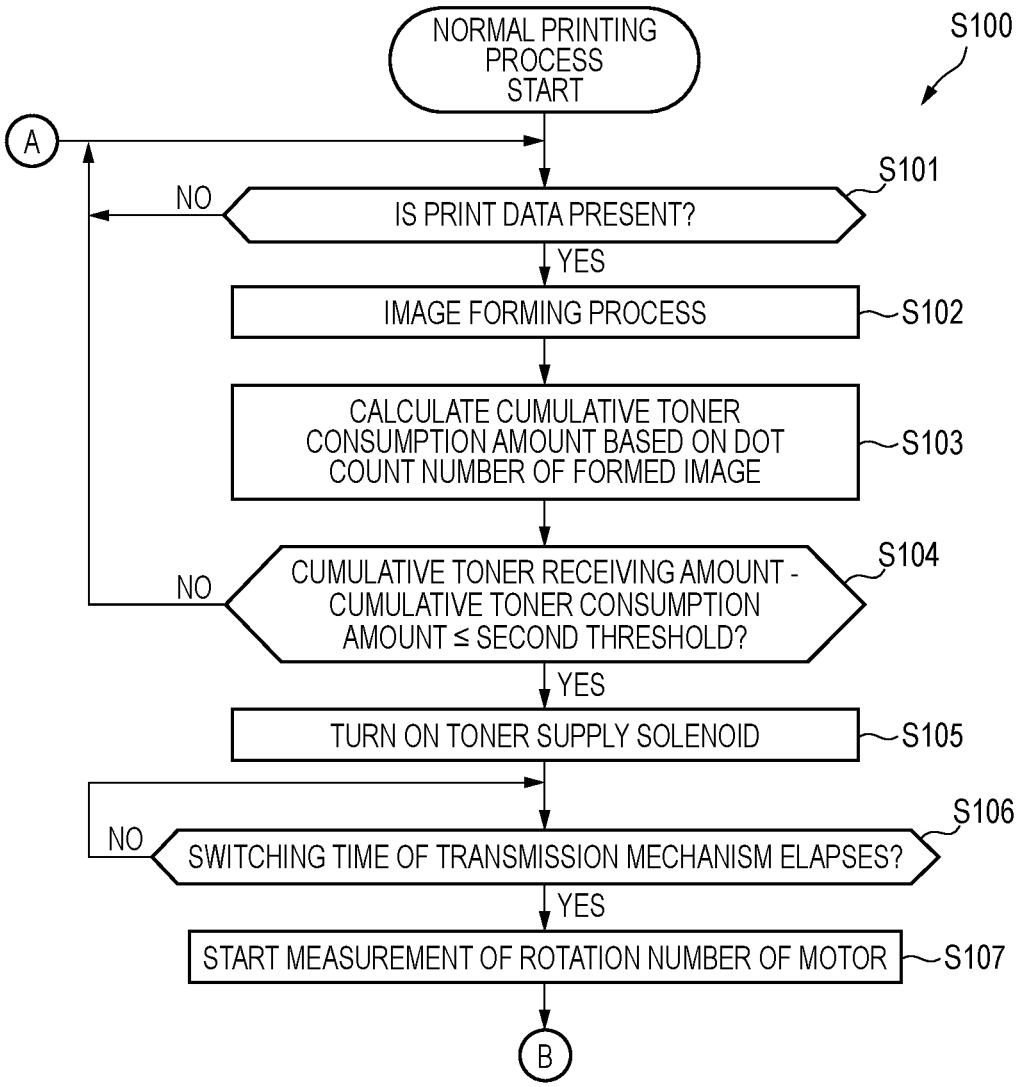
FIG. 7 is a flowchart showing a normal printing process.

In a case where the toner supply amount is not equal to or higher than the second supply amount, the controller 200 performs the normal printing process (see S100 in FIG. 7). Meanwhile, in a case where the toner supply amount is equal to or higher than the second supply amount, the controller 200 performs an emptiness determination process (see S12 in FIG. 6) of determining whether the cumulative toner supply amount is equal to or higher than a first supply amount for determining that the toner cartridge is empty. The first supply amount is a value higher than the second supply amount.

Figure 9:
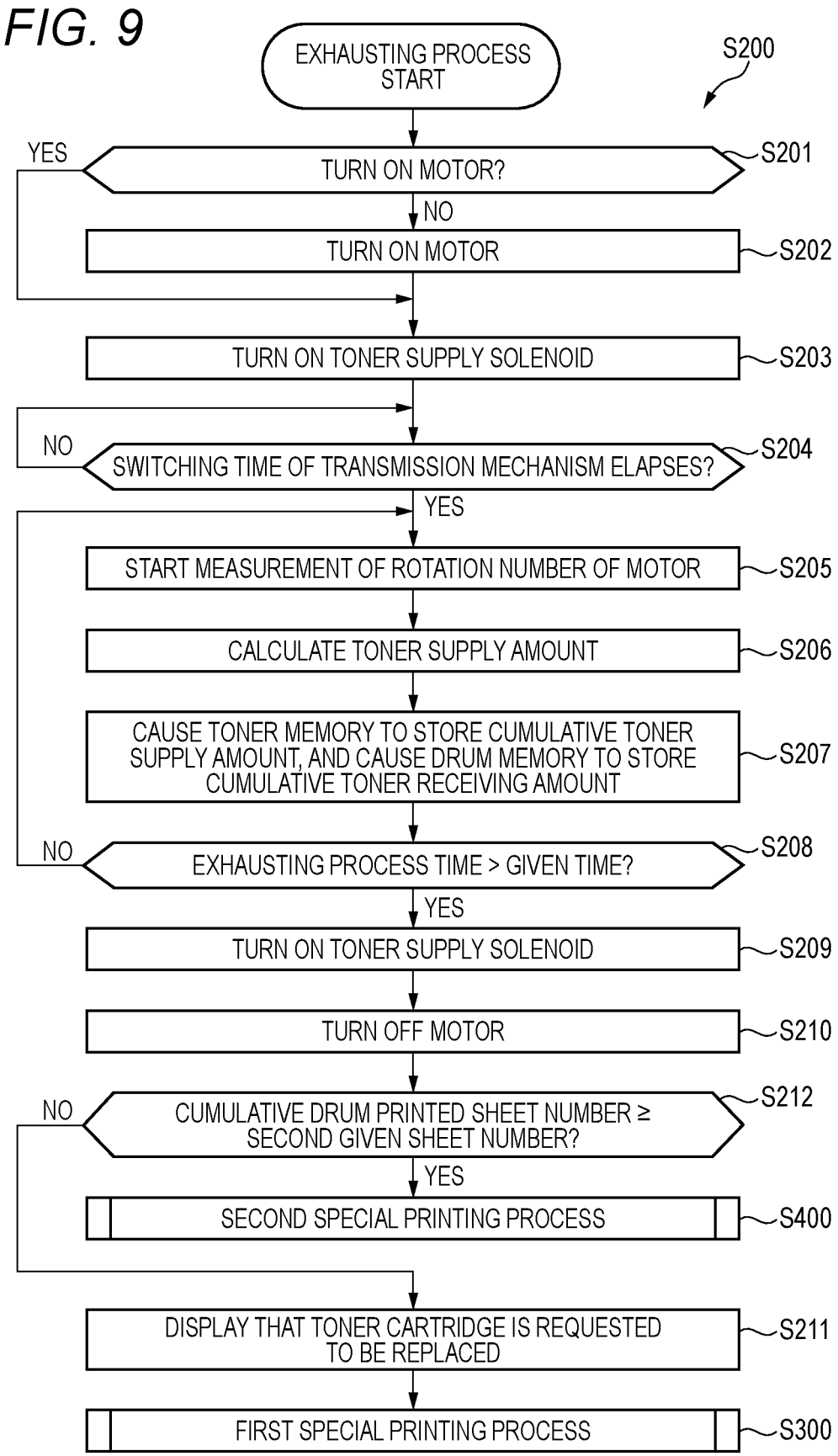
FIG. 9 is a flowchart showing a toner exhausting process.

In a case where the cumulative toner supply amount is lower than the first supply amount, the controller 200 performs the toner exhausting process (see S200 in FIG. 9). Meanwhile, in a case where the cumulative toner supply amount is equal to or higher than the first supply amount, the controller 200 determines whether the cumulative drum printing sheet number is equal to or higher than a second given sheet number (see step S14 in FIG. 6). When determining that the cumulative drum printing sheet number is equal to or higher than the second given sheet number, the controller 200 performs a second special printing process (see S400 in FIG. 11). Meanwhile, in a case where the controller 200 does not determine that the cumulative drum printing sheet number is equal to or higher than the second given sheet number, the controller 200 displays on the display a message requesting mounting the toner cartridge 2, and performs the first special printing process (see S300 in FIG. 10).

Next, the normal printing process (see FIGS. 7 and 8) will be described. The normal printing process is a normal printing process performed by the controller 200 in a case where the toner remains in the toner cartridge 2.

Specifically, in the normal printing process, the controller 200 performs an image forming process based on print data, and calculates the cumulative toner consumption amount based on a dot count number of the formed image. The controller 200 causes the auger 22 to operate to supply a first given amount of the toner to the developing chamber 11 when determining that a value obtained by subtracting the calculated cumulative toner consumption amount from the cumulative toner receiving amount stored in the drum memory 16 is equal to or lower than a second threshold (see S105 to S112 in FIGS. 7 and 8). The second threshold is a threshold determined based on an ideal amount of the toner accommodated in the developing chamber 11 when forming an image. The cumulative toner supply amount is calculated based on a rotation number of the motor 300 that drives the auger 22. The cumulative toner receiving amount is a value obtained by counting the toner supply amount of the toner cartridge 2 mounted to the drum cartridge 1 and cumulating the counted cumulative values.

The controller 200 repeats the normal printing process in a case where the cumulative toner supply amount is not equal to or higher than a fourth threshold, and performs a toner exhausting control in a case where the cumulative toner supply amount is equal to or higher than the fourth threshold.

Next, the toner exhausting process (see S200 in FIG. 9) will be described. The toner exhausting control is a process of completely discharging the remaining toner and supplying the remaining toner to the developing chamber 11 in a case where the remaining amount of the toner in the toner cartridge 2 is low.

Specifically, in the toner exhausting process, the controller 200 turns on the toner supply solenoid 28 for a given time, and causes the auger 22 to supply the remaining toner in the toner cartridge 2 to the developing chamber 11 (see S203 to S209 in FIG. 9). The controller 200 adds, to the cumulative toner receiving amount, an amount of the toner received from the toner cartridge 2 to the developing chamber 11 by the toner exhausting control, and causes the drum memory 16 to store the added value. The controller 200 adds the amount of the toner supplied from the toner cartridge 2 by the squeeze control to the cumulative toner supply amount, and causes the toner memory 26 to store the added value.

The controller 200 causes the memories to store the cumulative toner supply amount and the cumulative toner receiving amount, and then determines whether the cumulative drum printing sheet number is equal to or higher than the second given sheet number (see step S212 in FIG. 9). When determining that the cumulative drum printing sheet number is equal to or higher than the second given sheet number, the controller 200 performs the second special printing process (see S400 in FIG. 11). Meanwhile, in a case where the controller 200 does not determine that the cumulative drum printing sheet number is equal to or higher than the second given sheet number, the controller 200 displays on the display a message requesting replacement of the toner cartridge 2, and performs the first special printing process (see S300 in FIG. 10).

Next, the first special printing process (see S300 in FIG. 10) will be described. The first special printing process is a process in which an image is formed by a certain amount of the toner remaining in the drum cartridge 1 in a case where the controller determines that the toner cartridge 2 is empty and the controller determines that the toner cartridge is not mounted.

Figure 10:
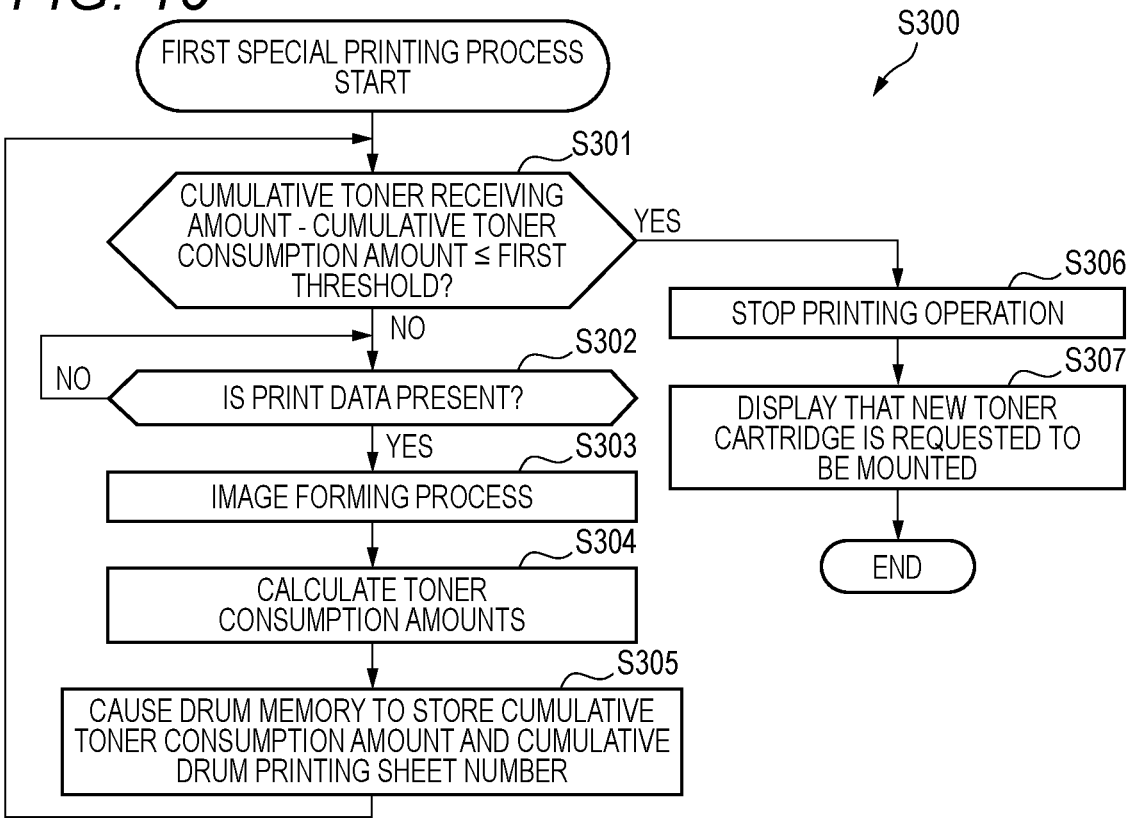
FIG. 10 is a flowchart showing a first special printing process.

Specifically, the controller 200 allows the image formation until the value obtained by subtracting the cumulative toner consumption amount from the cumulative toner receiving amount becomes equal to or lower than the first threshold (see S301 to S305 in FIG. 10). In other words, the controller 200 performs the image formation when determining that the value obtained by subtracting the cumulative toner consumption amount from the cumulative toner receiving amount is higher than the first threshold, and does not perform the image formation when determining that the value is equal to or lower than the first threshold. The first threshold is lower than the second threshold.

Next, the second special printing process (see S400 in FIG. 11) will be described. The second special printing process is a process in which in a case where the amount of the toner remaining in the drum cartridge 1 and the toner cartridge 2 is low, the image formation is performed with the remaining toner even though the lifetime of the drum cartridge 1 is exceeded.

Specifically, in a case where the controller 200 determines that the cumulative toner supply amount is equal to or higher than the first supply amount, and determines that the cumulative drum printing sheet number is equal to or higher than the second given sheet number which is lower than the first given sheet number, the controller 200 causes the display 180 not to display a message which suggest replacement of any of the drum cartridge 1 and the toner cartridge 2 until the value obtained by subtracting the cumulative toner consumption amount from the cumulative toner receiving amount becomes equal to or lower than the first threshold regardless of whether the cumulative drum printing sheet number is equal to or higher than the first given sheet number, and causes the display 180 to display a message requesting replacement of both the drum cartridge 1 and the toner cartridge 2 on a condition that the value obtained by subtracting the cumulative toner consumption amount from the cumulative toner receiving amount is equal to or lower than the first threshold.

Next, an example of the process of the embodiment performed by the controller 200 will be described with reference to the flowcharts of FIGS. 5 to 11. First, with reference to FIGS. 5 and 6, the process from turning on the power source or closing the cover up to the execution of any of the normal printing process, the toner exhausting process, the first special printing process, and the second special printing process will be described.

As shown in FIG. 5, the controller 200 determines whether the power source of the image forming apparatus 100 is turned on or the front cover 123 is closed (S1). In a case where the controller 200 does not determine that the power source is turned on or the front cover 123 is closed (S1, No), the controller 200 waits until the power source of the image forming apparatus 100 is turned on or the front cover 123 is closed.

In a case where the controller 200 determines that the power source of the image forming apparatus 100 is turned on or the front cover 123 is closed (S1, Yes), assuming that the drum cartridge 1 and the toner cartridge 2 may be replaced, the controller 200 reads the cumulative toner receiving amount and the cumulative toner consumption amount from the drum memory 16 (S2), reads the cumulative toner supply amount from the toner memory 26 (S3), and determines whether the drum cartridge 1 is mounted to the main body 120 (S4). The controller 200 attempts the communication when reading the information from the drum memory 16 in step S2, and determines that the drum cartridge 1 is mounted to the main body 120 in a case where the communication is successful.

In step S4, in a case where the controller 200 does not determine that the drum cartridge 1 is mounted (S4, No), the controller 200 displays on the display 180 a message requesting mounting of the drum cartridge 1 (S5), and the process ends.

In step S4, in a case where the controller 200 determines that the drum cartridge 1 is mounted (S4, Yes), the controller 200 determines whether the cumulative drum printing sheet number is equal to or higher than the first given sheet number (S41).

In step S41, in a case where the controller 200 determines that the cumulative drum printing sheet number is equal to or higher than the first given sheet number (S41, Yes), the controller 200 displays on the display 180 a message requesting replacement of the drum cartridge 1 (step S42), and the process proceeds to step S6.

In step S41, in a case where the controller 200 does not determine that the cumulative drum printing sheet number is equal to or higher than the first given sheet number (S41, No), the process proceeds to step S6.

In step S6, the controller 200 determines whether the toner cartridge 2 is mounted to the drum cartridge 1 (S6). The controller 200 attempts the communication when reading the information from the drum memory 26 in step S3, and determines that the toner cartridge 2 is mounted to the drum cartridge 1 in a case where the communication is successful.

In step S6, in a case where the controller 200 does not determine that the toner cartridge 2 is mounted (S6, No), the controller 200 displays on the display 180 a message requesting mounting the toner cartridge 2 (S7), and performs the special printing process (S300).

In step S6, in a case where the controller 200 determines that the toner cartridge 2 is mounted (S6, Yes), as shown in FIG. 6, the controller 200 determines whether the drum cartridge 1 is new (S8). In a case where the cumulative toner receiving amount read from the drum memory 16 in step S2 is zero, the controller 200 may determine that the drum cartridge 1 mounted to the main body 120 is new.

In step S8, in a case where the controller 200 determines that the drum cartridge 1 is new (S8, Yes), the controller 200 turns on the toner supply solenoid 28 for a given time (S9), and supplies the second given amount of the toner to the developing chamber 11 of the drum cartridge 1.

After step S9, the controller 200 causes the drum memory 16 to store the cumulative toner receiving amount, which is the amount of the toner supplied to the developing chamber 11 in step S9, and causes the toner memory 26 to store the cumulative toner supply amount supplied in step S9 (S10).

In step S8, in a case where the controller 200 does not determine that the drum cartridge 1 is new (S8, No) and after step S10, the controller 200 determines whether the cumulative toner supply amount is equal to or higher than the second supply amount (S11).

In step S11, in a case where the controller 200 does not determine that the cumulative toner supply amount is equal to or higher than the second supply amount (S11, No), since the sufficient toner remains in the toner cartridge 2, the controller 200 performs the normal printing process.

In step S11, in a case where the controller 200 determines that the cumulative toner supply amount is equal to or higher than the second supply amount (S11, Yes), the controller 200 determines whether the cumulative toner supply amount is equal to or higher than the first supply amount (S12).

In step S12, in a case where the controller 200 does not determine that the cumulative toner supply amount is equal to or higher than the first supply amount (S12, No), the controller 200 performs the toner exhausting process (S200).

In step S12, in a case where the controller 200 determines that the cumulative toner supply amount is equal to or higher than the first supply amount (S12, Yes), the controller 200 determines whether the cumulative drum printing sheet number is equal to or higher than the second given sheet number (S14).

In step S14, in a case where the controller 200 does not determine that the cumulative drum printing sheet number is equal to or higher than the second given sheet number (S14, No), the controller 200 displays on the display 180 a message requesting replacement of the toner cartridge 2 (S13), and performs the first special printing process (S300).

In step S14, in a case where the controller 200 determines that the cumulative drum printing sheet number is equal to or higher than the second given sheet number (S14, Yes), the controller 200 performs the second special printing process (S400).

Next, an example of the normal printing process will be described with reference to the flowcharts of FIGS. 7 and 8.

As shown in FIG. 7, in the normal printing process S100, the controller 200 determines whether the print data is present (S101), and the controller 200 performs the image forming process (S102) when determining that the print data is present (S101, Yes).

After step S102, the cumulative toner consumption amount is calculated based on the dot count number of the formed image (S103), and the controller determines whether the value obtained by subtracting the cumulative toner consumption amount from the cumulative toner receiving amount is equal to or lower than the second threshold (S104).

In step S104, in a case where the controller 200 does not determine that the value obtained by subtracting the cumulative toner consumption amount from the cumulative toner receiving amount is equal to or lower than the second threshold (S104, No), the process returns to step S101.

In step S104, in a case where the controller 200 determines that the value obtained by subtracting the cumulative toner consumption amount from the cumulative toner receiving amount is equal to or lower than the second threshold (S104, Yes), the controller 200 turns on the toner supply solenoid 28 (S105), waits until a switching time of the transmission mechanism 27 elapses (S106), and starts measurement of the rotation number of the motor 300 (S107).

Figure 8:
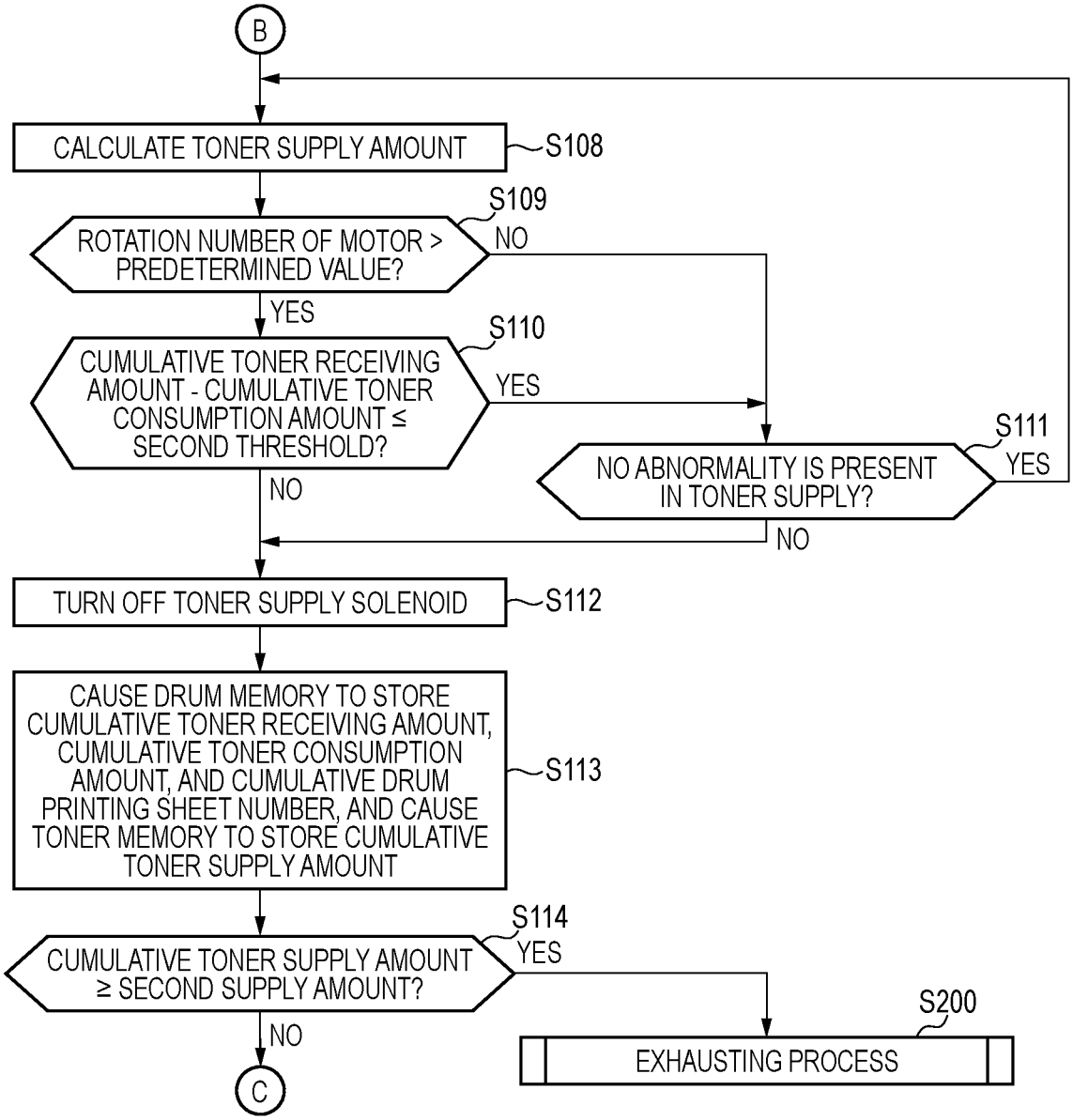
FIG. 8 is a flowchart continued from FIG. 7.

After step S107, as shown in FIG. 8, after starting the measurement of the rotation number of the motor 300 (S107), the controller 200 calculates the toner supply amount (S108), and determines whether the rotation number of the motor 300 is equal to or higher than a given value (S109).

In step S109, in a case where the controller 200 does not determine that the rotation number of the motor 300 is equal to or higher than the given value (S109, No), the controller 200 repeats the process from step S108 in a case where no abnormality is present in the toner supply (S111, Yes), and turns off the toner supply solenoid 28 (S112) in a case where an abnormality is present in the toner supply (S111, No).

In step S109, in a case where the controller 200 determines that the rotation number of the motor 300 is equal to or higher than the given value (S109, Yes), the controller 200 determines whether the value obtained by subtracting the cumulative toner consumption amount from the cumulative toner receiving amount is equal to or lower than the second threshold (S110).

In step S110, in a case where the controller 200 determines that the value obtained by subtracting the cumulative toner consumption amount from the cumulative toner receiving amount is equal to or lower than the second threshold (S110, Yes), the controller 200 repeats the process from step S108 in a case where no abnormality is present in the toner supply (S111, Yes), and turns off the toner supply solenoid 28 (S112) in a case where an abnormality is present in the toner supply (S111, No).

In step S110, in a case where the controller 200 does not determine that the value obtained by subtracting the cumulative toner consumption amount from the cumulative toner receiving amount is equal to or lower than the second threshold (S110, No), the controller 200 turns off the toner supply solenoid 28 (S112).

After step S112, the controller 200 causes the drum memory 16 to store the cumulative toner receiving amount and the cumulative toner consumption amount, causes the toner memory 26 to store the cumulative toner supply amount (S113), and determines whether the cumulative toner supply amount is equal to or higher than the second supply amount (S114).

In step S114, in a case where the controller 200 does not determine that the cumulative toner supply amount is equal to or higher than the second supply amount (S114, No), the controller 200 continues to perform a normal print control, and thus the process returns to step S101.

In step S114, in a case where the controller 200 determines that the cumulative toner supply amount is equal to or higher than the second supply amount (S114, Yes), the controller 200 performs the toner exhausting control (S200).

Next, an example of the toner exhausting process will be described with reference to the flowchart of FIG. 9.

As shown in FIG. 9, in the toner exhausting process S200, in a case where the motor 300 is not turned on (S201, No), the motor 300 is turned on (S202), and the toner supply solenoid 28 is turned on (S203).

After step S203, the controller 200 waits until the switching time of the transmission mechanism 27 elapses (S204), starts the measurement of the rotation number of the motor 300 (S205), and calculates the toner supply amount (S206) after starting the measurement of the rotation number of the motor 300 (S205).

After step S206, the controller 200 causes the toner memory 26 to store the cumulative toner supply amount and causes the drum memory 16 to store the cumulative toner receiving amount (S207). Thereafter, the controller determines from step 205 whether the elapsed time, that is, an exhausting process time exceeds a given time (S208).

In step S208, in a case where the controller 200 does not determine that the exhausting process time exceeds the given time (S208, No), the process returns to step S205, and in a case where the controller 200 determines that the exhausting process time exceeds the given time (S208, Yes), the controller 200 turns off the toner supply solenoid 28 (S209), turns off the motor 300 (S210), and determines whether a cumulative drum printed sheet number is equal to or higher than the second given sheet number (S212).

In step S212, in a case where the controller 200 determines that the cumulative drum printed sheet number is equal to or higher than the second given sheet number (S212, Yes), the controller 200 performs the second special printing process (S400).

In step S212, in a case where the controller 200 does not determine that the cumulative drum printed sheet number is equal to or higher than the second given sheet number (S212, No), the controller 200 displays on the display 180 a message requesting replacement of the toner cartridge 2 (S211), and performs the first special printing process (S300).

Next, an example of the first special printing process will be described with reference to the flowchart of FIG. 10.

As shown in FIG. 10, in the first special printing process S300, the controller 200 determines whether the value obtained by subtracting the cumulative toner consumption amount from the cumulative toner receiving amount is equal to or lower than the first threshold (S301).

In step S301, in a case where the controller 200 does not determine that the value obtained by subtracting the cumulative toner consumption amount from the cumulative toner receiving amount is equal to or lower than the first threshold (S301, No), the controller 200 waits until the print data is present (S302), and performs the image forming process (S303) in a case where the print data is present (S302, Yes).

After step S303, the controller 200 calculates toner consumption amounts for forming images (S304), causes the drum memory 16 to store the cumulative toner consumption amount obtained by adding the calculated toner consumption amounts (S305), and the process returns to step S301.

In step S301, in a case where the controller 200 determines that the value obtained by subtracting the cumulative toner consumption amount from the cumulative toner receiving amount is equal to or lower than the first threshold (S301, Yes), the controller 200 stops a printing operation (S306) because an image cannot be formed with the amount of the toner remaining in the developing chamber 11, and displays on the display 180 a message requesting mounting a new toner cartridge 2 (S307), and the process ends.

Next, an example of the second special printing process will be described with reference to the flowchart of FIG. 11.

Figure 11:
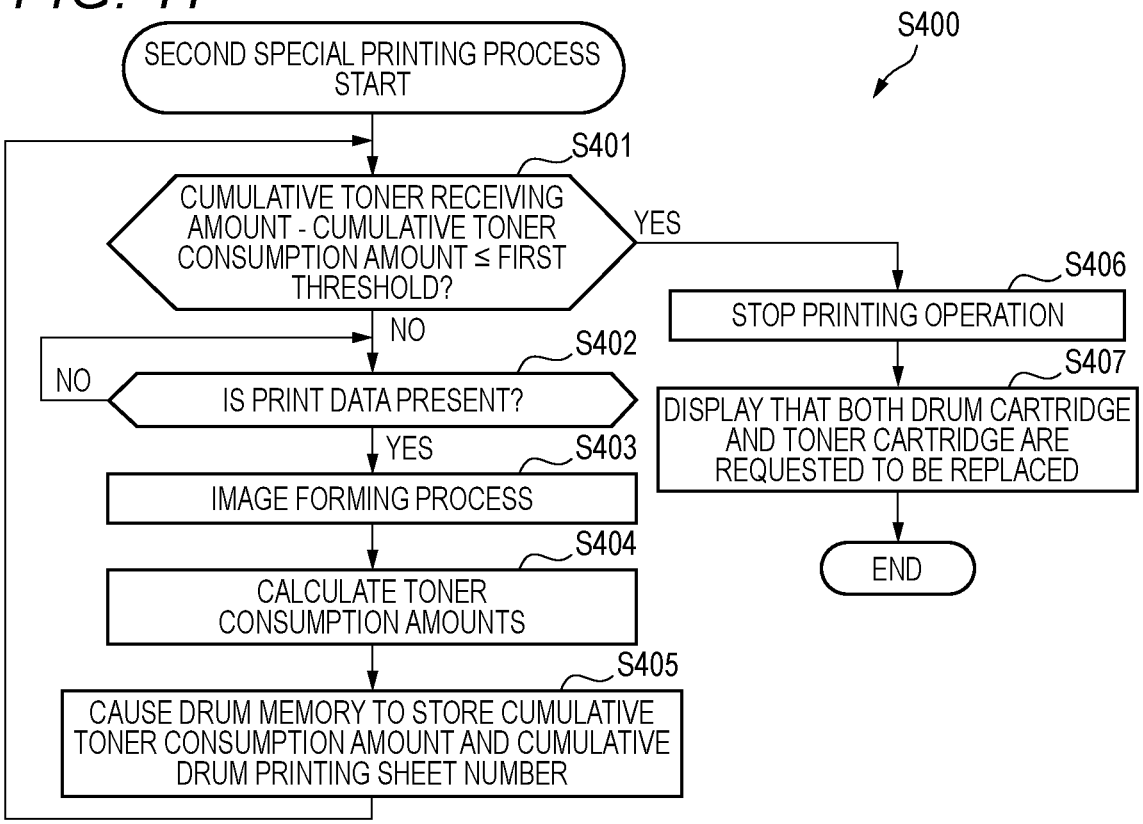
FIG. 11 is a flowchart showing a second special printing process.

As shown in FIG. 11, in the second special printing process S400, the controller 200 determines whether the value obtained by subtracting the cumulative toner consumption amount from the cumulative toner receiving amount is equal to or lower than the first threshold (S401).

In step S401, in a case where the controller 200 does not determine that the value obtained by subtracting the cumulative toner consumption amount from the cumulative toner receiving amount is equal to or lower than the first threshold (S401, No), the controller 200 waits until the print data is present (S402), and performs the image forming process (S403) in a case where the print data is present (S402, Yes).

After step S403, the controller 200 calculates the toner consumption amounts for forming images (S404), causes the drum memory 16 to store the cumulative toner consumption amount obtained by adding the calculated toner consumption amounts (S405), and the process returns to step S401.

In step S401, in a case where the controller 200 determines that the value obtained by subtracting the cumulative toner consumption amount from the cumulative toner receiving amount is equal to or lower than the first threshold (S401, Yes), the controller 200 stops the printing operation (S406) because an image cannot be formed with the amount of the toner remaining in the developing chamber 11, and displays on the display 180 a message requesting replacement of both a new drum cartridge 1 and a new toner cartridge 2 (S407), and the process ends.

In a case where the controller 200 of the image forming apparatus 100 determines that the cumulative toner supply amount is equal to or higher than the first supply amount, and determines that the cumulative drum printing sheet number is equal to or higher than the second given sheet number which is lower than the first given sheet number, the controller 200 causes the display 180 not to display any message requesting replacement of the drum cartridge 1 and the toner cartridge 2 until the value obtained by subtracting the cumulative toner consumption amount from the cumulative toner receiving amount becomes equal to or lower than the first threshold regardless of whether the cumulative drum printing sheet number is equal to or higher than the first given sheet number, and causes the display 180 to display a message requesting replacement of both the drum cartridge 1 and the toner cartridge 2 on the condition that the value obtained by subtracting the cumulative toner consumption amount from the cumulative toner receiving amount is equal to or lower than the first threshold. Therefore, according to the image forming apparatus 100, a number of times the drum cartridge 1 and the toner cartridge 2 are individually replaced is reduced.

In a case where the cumulative drum printing sheet number is equal to or higher than the second given sheet number, the controller 200 causes the display 180 to display a message indicating that the drum cartridge 1 is close to empty, so that a user notices that the drum cartridge 1 is about to reach the end of a lifetime.

The present disclosure is not limited to the embodiment described above, and may be implemented in various modifications as shown below.

In the embodiment described above, the controller 200 determines a lifetime of the photosensitive drum 10 based on the cumulative drum printing sheet number, and the lifetime of the photosensitive drum 10 may be determined based on the cumulative rotation number of the photosensitive drum 10.

In this case, the controller 200 causes the drum memory 16 to store the cumulative rotation number of the photosensitive drum 10 that performs the image formation.

The controller 200 causes the display 180 to display the message requesting replacement of the drum cartridge 1 when determining that the cumulative rotation number stored in the drum memory 16 is equal to or higher than the first given number for determining that the drum cartridge 1 is empty.

In a case where the controller 200 determines that the cumulative toner supply amount is equal to or higher than the first supply amount, and determines that the cumulative rotation number is equal to or higher than the second given number, the controller 200 causes the display 180 not to display any message requesting replacement of the drum cartridge 1 or the toner cartridge 2 until the value obtained by subtracting the cumulative toner consumption amount from the cumulative toner receiving amount becomes equal to or lower than the first threshold regardless of whether the cumulative rotation number is equal to or higher than the first given number, and causes the display 180 to display the message requesting replacement of both the drum cartridge 1 and the toner cartridge 2 on the condition that the value obtained by subtracting the cumulative toner consumption amount from the cumulative toner receiving amount is equal to or lower than the first threshold.

Further, the controller 200 may be configured to cause the display 180 to display the message indicating that the drum cartridge 1 is close to empty when determining that the cumulative rotation number is equal to or higher than the second given number.

According to such a configuration, similar to the embodiment described above, in a case where the cumulative toner supply amount is equal to or higher than the first supply amount and the cumulative rotation number is equal to or higher than the second given number, the display 180 does not display any message requesting replacement of the drum cartridge 1 or the toner cartridge 2 until the value obtained by subtracting the cumulative toner consumption amount from the cumulative toner receiving amount becomes equal to or lower than the first threshold regardless of whether the cumulative rotation number is equal to or higher than the first given number, and thus a number of times the drum cartridge 1 and the toner cartridge 2 are individually replaced is reduced.

In a case where the cumulative rotation number is equal to or higher than the second given number, the message indicating that the drum cartridge 1 is close to empty is displayed on the display 180, so that a user notice that the drum cartridge 1 is about to reach the end of a lifetime.

In the embodiment described above, the second threshold is determined based on an ideal amount of the toner accommodated in the developing chamber 11 when forming an image, and the second threshold may be determined based on the first threshold. In this case, the first threshold may be determined based on the ideal amount of the toner accommodated in the developing chamber 11, and then the second threshold may be determined based on the first threshold as a value higher than the first threshold.

In the embodiment described above, the controller 200 determines that the drum cartridge 1 mounted to the main body 120 is new in a case where the cumulative toner receiving amount read from the drum memory 16 is zero, and the controller 200 may determine that the drum cartridge 1 mounted to the main body 120 is new in a case where the cumulative drum printing sheet number read from the drum memory 16 is zero. Further, the controller 200 may determine a new product by another method.

In the embodiment described above, the auger 22 having the spiral plate 22B is exemplified as the supply unit, but the present disclosure is not limited thereto, and the supply unit may include, for example, a rotation shaft and a flat plate provided parallel to the rotation shaft.

In the embodiment described above, the photosensitive drum 10 is exemplified as a photoconductor, but the present disclosure is not limited thereto, and for example, a belt-shaped photoconductor may be used.

In the embodiment described above, the cumulative toner consumption amount is calculated based on the dot count number of the image, but the present disclosure is not limited thereto, and for example, the toner consumption amount may be acquired based on a printed sheet number, a rotation number of the photosensitive drum, a number of times the sheet is detected by a sheet sensor, and the like.

In the embodiment described above, the sheet S such as a thick sheet, a postcard, and a thin sheet is exemplified, but the present disclosure is not limited thereto, and may be, for example, an OHP sheet.

Although the embodiment described above is a monochrome laser printer, the present disclosure may be applied to a color laser printer, and other image forming apparatuses, for example, a copying machine and a multifunction device.

Elements described in the embodiment and the modifications described above may be optionally combined and implemented. While the disclosure has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the disclosure, and not limiting the disclosure. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described disclosure are provided below:

What is claimed is:

1. An image forming apparatus comprising:

a main body including a display;

a drum cartridge configured to be mounted to the main body and including:

a photosensitive drum;

a developing chamber configured to accommodate toner; and a drum memory;

a toner cartridge configured to be mounted to the drum cartridge and including:

a housing configured to accommodate the toner;

a supply unit configured to supply the toner from the housing to the developing chamber; and a toner memory; and a controller configured to:

store, in the drum memory, a cumulative toner receiving amount which is a cumulative amount of the toner supplied from the toner cartridge and received in the developing chamber, a cumulative toner consumption amount which is a cumulative amount of the consumed toner, and a cumulative drum printing sheet number which is a number of sheets on which an image is formed by the photosensitive drum, store, in the toner memory, a cumulative toner supply amount which is a cumulative amount of the toner supplied by the supply unit from the housing to the developing chamber, display, on the display. a message requesting replacement of the drum cartridge in a case where the controller determines that the cumulative drum printing sheet number is equal to or higher than a first given sheet number for determining whether the drum cartridge is empty, display, on the display, a message requesting replacement of the toner cartridge in a case where the controller determines that the cumulative toner supply amount of the toner cartridge is equal to or higher than a first supply amount for determining whether the toner cartridge is empty, in a case where the controller determines that the cumulative toner supply amount is equal to or higher than the first supply amount and the cumulative drum printing sheet number is equal to or higher than a second given sheet number which is lower than the first given sheet number, cause the display not to display any message requesting replacement of the drum cartridge or the toner cartridge until a value obtained by subtracting the cumulative toner consumption amount from the cumulative toner receiving amount becomes equal to or lower than a first threshold regardless of whether the cumulative drum printing sheet number is equal to or higher than the first given sheet number, and display, on the display, a message requesting replacement of both the drum cartridge and the toner cartridge on a condition that the value obtained by subtracting the cumulative toner consumption amount from the cumulative toner receiving amount is equal to or lower than the first threshold.

2. The image forming apparatus according to claim 1, wherein the controller is configured to display, on the display, a message indicating that the drum cartridge is close to empty in a case where the controller determines that the cumulative drum printing sheet number is equal to or higher than the second given sheet number.

3. The image forming apparatus according to claim 1, wherein the controller is configured to cause the supply unit to supply the toner with a first given amount to the developing chamber in a case where the value obtained by subtracting the cumulative toner consumption amount from the cumulative toner receiving amount stored in the drum memory is equal to or lower than a second threshold.

4. The image forming apparatus according to claim 1, wherein the supply unit includes an auger that is configured to supply the toner to the developing chamber by rotating about a rotation shaft, and the controller is configured to acquire the cumulative toner supply amount based on a rotation number of a motor that drives the auger.

5. The image forming apparatus according to claim 1, wherein the controller is configured to obtain the cumulative toner consumption amount based on a dot count number of an image formed by the image forming apparatus.

6. The image forming apparatus according to claim 1, wherein the controller is configured to perform:

a new product determination process of determining whether the drum cartridge mounted to the main body is new, and a supply process of causing the supply unit to supply the toner with a second given amount to the developing chamber in a case where the controller determines that the drum cartridge mounted to the main body is new.

7. The image forming apparatus according to claim 1, wherein the controller is configured to perform:

a first mounting determination process of determining whether the drum cartridge is mounted to the main body, an emptiness determination process of determining whether the cumulative toner supply amount of the toner cartridge is equal to or higher than a second threshold for determining whether the toner cartridge is empty, and a process in which, in a case where the controller determines in the first mounting determination process that the drum cartridge is mounted to the main body, and the controller determines in the emptiness determination process that the cumulative toner supply amount of the toner cartridge is equal to or higher than the second threshold for determining whether the toner cartridge is empty, image formation is allowed until the value obtained by subtracting the cumulative toner consumption amount from the cumulative toner receiving amount becomes equal to or lower than a third threshold.

8. The image forming apparatus according to claim 1, wherein the controller is configured to perform:

a first mounting determination process of determining whether the drum cartridge is mounted to the main body, a second mounting determination process of determining whether the toner cartridge is mounted to the drum cartridge, and a process in which, in a case where the controller determines in the first mounting determination process that the drum cartridge is mounted to the main body, and the controller does not determine in the second mounting determination process that the toner cartridge is mounted to the drum cartridge, image formation is allowed until the value obtained by subtracting the cumulative toner consumption amount from the cumulative toner receiving amount becomes equal to or lower than a third threshold.

9. The image forming apparatus according to claim 1, wherein the controller is configured to:

perform a toner exhausting process to exhaust the toner remaining in the toner cartridge in a case where the cumulative toner supply amount is equal to or higher than a fourth threshold, add, to the cumulative toner receiving amount, an amount of the toner received from the toner cartridge into the developing chamber by the toner exhausting process and store the added value in the drum memory, and add, to the cumulative toner supply amount, an amount of the toner supplied from the toner cartridge by the toner exhausting control and store the added value to the toner memory.

10. The image forming apparatus according to claim 1, wherein the controller is configured to obtain toner supply amounts from the toner cartridge mounted to the drum cartridge and obtain the cumulative toner receiving amount using the obtained toner supply amounts.

11. An image forming apparatus, comprising:

a main body including a display;

a drum cartridge configured to be mounted to the main body and including:

a photosensitive drum;

a developing chamber configured to accommodate toner; and a drum memory;

a toner cartridge configured to be mounted to the drum cartridge and including:

a housing configured to accommodate the toner;

a supply unit configured to supply the toner from the housing to the developing chamber; and a toner memory; and a controller configured to:

store, in the drum memory, a cumulative toner receiving amount which is a cumulative amount of the toner supplied from the toner cartridge and received in the developing chamber, a cumulative toner consumption amount which is a cumulative amount of the consumed toner, and a cumulative rotation number of the photosensitive drum performing image formation, store, in the toner memory, a cumulative toner supply amount which is a cumulative amount of the toner supplied by the supply unit from the housing to the developing chamber, display, on the display, a message requesting replacement of the drum cartridge in a case where the controller determines that the cumulative rotation number is equal to or higher than a first given number for determining whether the drum cartridge is empty, display, on the display, a message requesting replacement of the toner cartridge in a case where the controller determines that the cumulative toner supply amount of the toner cartridge is equal to or higher than a first supply amount for determining whether the toner cartridge is empty, in a case where the controller determines that the cumulative toner supply amount is equal to or higher than the first supply amount and the cumulative rotation number is equal to or higher than a second given number which is lower than the first given number, cause the display not to display any message requesting replacement of the drum cartridge or the toner cartridge until a value obtained by subtracting the cumulative toner consumption amount from the cumulative toner receiving amount becomes equal to or lower than a first threshold regardless of whether the cumulative rotation number is equal to or higher than the first given number, and display, on the display, a message requesting replacement of both the drum cartridge and the toner cartridge on a condition that the value obtained by subtracting the cumulative toner consumption amount from the cumulative toner receiving amount is equal to or lower than the first threshold.

12. The image forming apparatus according to claim 11, wherein the controller is configured to display, on the display, a message indicating that the drum cartridge is close to empty in a case where the controller determines that the cumulative rotation number is equal to or higher than the second given number.

13. The image forming apparatus according to claim 11, wherein the controller is configured to cause the supply unit to supply the toner with a first given amount to the developing chamber in a case where the value obtained by subtracting the cumulative toner consumption amount from the cumulative toner receiving amount stored in the drum memory is equal to or lower than a second threshold.

14. The image forming apparatus according to claim 11, wherein the supply unit includes an auger that is configured to supply the toner to the developing chamber by rotating about a rotation shaft, and the controller is configured to acquire the cumulative toner supply amount based on a rotation number of a motor that drives the auger.

15. The image forming apparatus according to claim 11, wherein the controller is configured to obtain the cumulative toner consumption amount based on a dot count number of an image formed by the image forming apparatus.

16. The image forming apparatus according to claim 11, wherein the controller is configured to perform:

a new product determination process of determining whether the drum cartridge mounted to the main body is new, and a supply process of causing the supply unit to supply the toner with a second given amount to the developing chamber in a case where the controller determines that the drum cartridge mounted to the main body is new.

17. The image forming apparatus according to claim 11, wherein the controller is configured to perform:

a first mounting determination process of determining whether the drum cartridge is mounted to the main body, an emptiness determination process of determining whether the cumulative toner supply amount of the toner cartridge is equal to or higher than a second threshold for determining whether the toner cartridge is empty, and a process in which, in a case where the controller determines in the first mounting determination process that the drum cartridge is mounted to the main body, and the controller determines in the emptiness determination process that the cumulative toner supply amount of the toner cartridge is equal to or higher than the second threshold for determining whether the toner cartridge is empty, image formation is allowed until the value obtained by subtracting the cumulative toner consumption amount from the cumulative toner receiving amount becomes equal to or lower than a third threshold.

18. The image forming apparatus according to claim 11, wherein the controller is configured to perform:

a first mounting determination process of determining whether the drum cartridge is mounted to the main body, a second mounting determination process of determining whether the toner cartridge is mounted to the drum cartridge, and a process in which, in a case where the controller determines in the first mounting determination process that the drum cartridge is mounted to the main body, and the controller does not determine in the second mounting determination process that the toner cartridge is mounted to the drum cartridge, image formation is allowed until the value obtained by subtracting the cumulative toner consumption amount from the cumulative toner receiving amount becomes equal to or lower than a third threshold.

19. The image forming apparatus according to claim 11, wherein the controller is configured to:

perform a toner exhausting process to exhaust the toner remaining in the toner cartridge in a case where the cumulative toner supply amount is equal to or higher than a fourth threshold, add, to the cumulative toner receiving amount, an amount of the toner received from the toner cartridge into the developing chamber by the toner exhausting process and store the added value in the drum memory, and add, to the cumulative toner supply amount, an amount of the toner supplied from the toner cartridge by the toner exhausting control and store the added value to the toner memory.

20. The image forming apparatus according to claim 11, wherein the controller is configured to obtain toner supply amounts from the toner cartridge mounted to the drum cartridge and obtain the cumulative toner receiving amount using the obtained toner supply amounts.

* * * * *